US007360527B2

(12) United States Patent
Heinstein

(10) Patent No.: US 7,360,527 B2
(45) Date of Patent: Apr. 22, 2008

(54) METHOD FOR OPERATING AN INTERNAL COMBUSTION ENGINE

(75) Inventor: Axel Heinstein, Wimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/584,253

(22) PCT Filed: Nov. 16, 2004

(86) PCT No.: PCT/EP2004/052967

§ 371 (c)(1),
(2), (4) Date: Jun. 23, 2006

(87) PCT Pub. No.: WO2005/068828

PCT Pub. Date: Jul. 28, 2005

(65) Prior Publication Data

US 2007/0101805 A1 May 10, 2007

(30) Foreign Application Priority Data

Jan. 13, 2004 (DE) ..... 10 2004 001 716

(51) Int. Cl.
*F02M 51/00* (2006.01)
*F01L 1/34* (2006.01)

(52) U.S. Cl. ..... 123/491; 123/90.17; 701/102

(58) Field of Classification Search ..... 123/491, 123/490, 90.17; 701/102; 73/117.3
See application file for complete search history.

(56) References Cited

U.S. PATENT DOCUMENTS 4,329,645 A * 5/1982 Takase ..... 324/166
5,152,178 A * 10/1992 Kadota ..... 73/118.1
5,379,634 A * 1/1995 Kuroda et al. ..... 73/116
5,425,340 A 6/1995 Petitbon et al.
5,469,823 A * 11/1995 Ott et al. ..... 123/406.62
5,680,846 A 10/1997 Bauer et al.
5,715,780 A * 2/1998 Haller ..... 123/90.17
5,809,973 A 9/1998 Iida et al.
6,019,086 A * 2/2000 Schneider et al. ..... 123/406.61
6,050,232 A 4/2000 Grob et al.
6,050,242 A * 4/2000 Wilkinson ..... 123/406.58

(Continued)

FOREIGN PATENT DOCUMENTS

DE 197 43 492 4/1999

(Continued)

*Primary Examiner*—John T. Kwon
(74) *Attorney, Agent, or Firm*—Michael J. Striker

(57) ABSTRACT

A method for operating an internal combustion engine, particularly of a motor vehicle, is described. The engine has a number of cylinders (Z1, Z2, Z3, Z4), and in each of the cylinders (Z1, Z2, Z3, Z4), one movable piston is accommodated, which is capable of passing through an intake phase (S), a compression phase (V), a working phase (A), and an expulsion phase (B). The fuel can be injected directly into a combustion chamber defined by the cylinder (Z1, Z2, Z3, Z4) and the piston. A first output signal (P1) is generated, which always changes its value whenever a transition from one phase to the next phase of the engine is taking place. A second output signal (P2) is generated, which always changes its value upon every other transition between two phases of the engine. The two output signals (P1, P2) are generated independently from one another, and from the two output signals, the present phase of at least one of the cylinders (Z1, Z2, Z3, Z4) is ascertained.

8 Claims, 2 Drawing Sheets

| | | | | |
|---|---|---|---|---|
| Z1 | S | V | A | B |
| Z2 | V | A | B | S |
| Z3 | B | S | V | A |
| Z4 | A | B | S | V |

U.S. PATENT DOCUMENTS 6,647,955 B1 11/2003 Sieber
6,752,134 B1 * 6/2004 Wilkinson ..... 123/609

FOREIGN PATENT DOCUMENTS

DE 199 60 984 6/2001
DE 100 44 741 8/2001
EP 0 475 566 3/1992
EP 0 846 852 6/1998
EP 1 284 349 2/2003

* cited by examiner

Fig. 1
| | | | | |
|---|---|---|---|---|
| Z1 | S | V | A | B |
| Z2 | V | A | B | S |
| Z3 | B | S | V | A |
| Z4 | A | B | S | V |
Fig. 2a
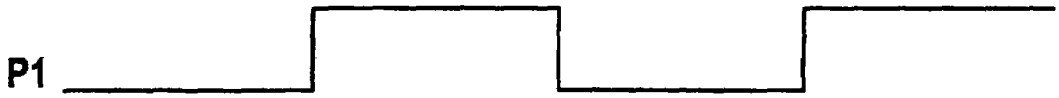
Fig. 2b
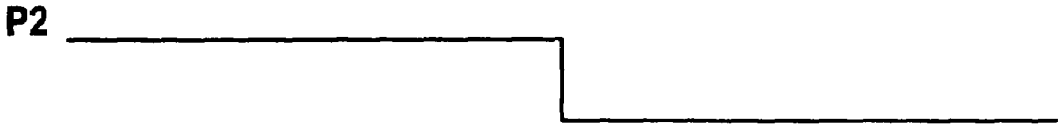
Fig. 3
| | | | | |
|---|---|---|---|---|
| E | Z4 | Z2 | Z1 | Z3 |

METHOD FOR OPERATING AN INTERNAL COMBUSTION ENGINE

BACKGROUND OF THE INVENTION

The invention is based on a method for operating an internal combustion engine. The invention also relates to a corresponding control unit for an internal combustion engine.

A method and a control unit of this kind are known from German Patent Disclosure DE 197 43 492 A1. A direct-injection internal combustion engine is described there, in which in normal operation, the fuel can be injected directly into the combustion chamber of the engine even during the compression phase, as well as other phases.

For starting the engine, it is proposed there that the fuel be injected directly in a first injection into the particular combustion chamber whose piston is in the working phase. After that, the fuel is ignited with the aid of the spark plug belonging to that combustion chamber. Next, fuel is injected into the other cylinders of the engine and ignited, so that the engine begins a rotary motion.

Since in the method described no electric starter is necessary, this method is also known as direct starting.

For detecting the working phase of the individual cylinders of the engine, it is provided in DE 197 43 492 A1 that the rpm sensor of the engine be embodied as an absolute angle sensor, which is capable of indicating the rotary angle of the engine at any time, and hence even after the engine has been stopped.

For preparing for a direct start, it is known from German Patent Disclosure DE 199 60 984 A1 to put the engine, as it comes to a stop beforehand purposefully into an angular position that is advantageous for the direct start. For that end, a valve controller is provided there, with which a desired piston runs to a stop purposefully, for instance at an angular crankshaft position of 90 degrees after top dead center.

SUMMARY OF THE INVENTION

The object of the invention is to create a method for operating an internal combustion engine and a control unit for an internal combustion engine which are constructed simply and economically.

With the aid of the two output signals according to the invention, it is possible for instance to ascertain the particular cylinder whose piston is in a working phase at the time. For the sake of a direct start, fuel can then be injected into that cylinder first.

One advantage of the method of the invention is that no absolute angle sensor is necessary. Instead, it suffices to ascertain the two output signals, in particular with the aid of two sensors, that are associated with two camshafts, for instance, or with one crankshaft and one camshaft. Such sensors are substantially simpler in construction and thus substantially less expensive than absolute angle sensors.

In an advantageous refinement of the invention, the two output signals are subjected to an AND or OR operation. It is thus possible to ascertain whether a direct start appears readily possible or appears possible only under certain peripheral conditions. Thus by these provisions, the reliability of the direct start to be performed is charged beforehand.

Further characteristics, possible applications, and advantages of the invention will become apparent from the ensuing description of exemplary embodiments of the invention, which are shown in the drawings. All the characteristics described or shown, on their own or in arbitrary combination, form the subject of the invention, regardless of how they are summarized in the claims and regardless of the claims dependencies and regardless of how they are worded or shown in the description and in the drawings.

BRIEF DESCRIPTION OF THE DRAWINGS

FIG. 1 shows a schematic timing diagram of the sequence of the intake, compression, work and expulsion phases of a four-cylinder internal combustion engine;

FIGS. 2*a* and 2*b* show schematic timing diagrams of the output signals of a first exemplary embodiment of a phase transducer;

FIG. 3 shows a schematic timing diagram of an outcome that characterizes the working phases of the individual cylinders of the engine of FIG. 1;

DETAILED DESCRIPTION OF THE PREFERRED EMBODIMENT

Figure 4A:
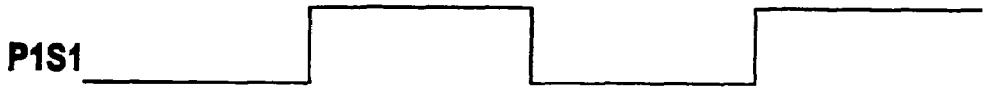
FIGS. 4*a* through 4*d* show schematic timing diagrams of the output signals of a second exemplary embodiment of a phase transducer.

In FIG. 1 of the present patent application, the sequence of the individual phases of an internal combustion engine is shown over time. These phases correspond to the cycles of an internal combustion engine as shown and described in further detail in DE 197 43 492 A1.

In FIG. 1 of the present patent application, the engine has four cylinders Z1, Z2, Z3, Z4. In each of these cylinders, in an intake phase S, air is first aspirated into the combustion chamber via the intake manifold of the engine. Then, in a compression phase V, the aspirated air is compressed in the combustion chamber. Simultaneously in this compression phase V, the fuel is injected via an injection valve directly into the combustion chamber. In an ensuing working phase A, the fuel present in the combustion chamber is ignited with the aid of a spark plug. The fuel combusts, and the resultant expansion of the fuel-air mixture sets the piston of the engine into motion. After that, in an expulsion phase B, the combusted fuel-air mixture is expelled from the combustion chamber.

By now, the crankshaft of the engine has passed through an angle of 720 degrees, and the aforementioned phases of the engine can begin over again.

The individual phases S, V, A, B in the individual cylinders Z1, Z2, Z3, Z4 are controlled or regulated with the aid of at least one camshaft and associated valves.

The aforementioned phases take place offset from one another in the various cylinders of the engine. The sequence of the cylinders shown in FIG. 1 corresponds to the known sequence of four-cylinder engine, namely Z1->Z3->Z4->Z2->Z1->etc.

In FIGS. 2*a* and 2*b*, output signals P1, P2 of a first phase transducer are shown, which is associated with the engine of FIG. 1. For generating these output signals, two transducer wheels are provided, and each of the transducer wheels is assigned one sensor. If there are two camshafts, which is assumed in the present exemplary embodiment, then these two camshafts are each provided with transducer wheel. If there is only one camshaft, then the crankshaft and the camshaft can each be provided with one transducer wheel to generate the output signals.

It is also possible for there to be only a single, so-called two-track transducer wheel, which is located on the single camshaft and to which a corresponding sensor is assigned.

The sensors are in particular so-called true-power-on sensors, which are already capable as soon as the engine is turned on of detecting the position of the transducer wheel without any rotation of the transducer wheel. Such a sensor is described for instance in German Patent Disclosure DE 100 44 741 A1.

The two transducer wheels are embodied such that the two sensors generate the output signals P1, P2 as shown in FIGS. 2*a* and 2*b*.

The output signal P1 always changes its value whenever a transition is taking place between successive phases in FIG. 1. The output signal P1 has the values "0" and "1". The output signal P1 thus characterizes the individual phases of the engine.

The output signal P2 is generated independently of the output signal P1. The output signal P2 always changes its value at every other transition between successive phases of FIG. 1. The output signal P2 likewise has the values "0" and "1".

In FIG. 3, an outcome E is shown, which characterizes the working phases of the various cylinders of the engine of FIG. 1. The outcome E is the outcome of a combination of the output signals P1 and P2, as follows: If P1=0 and P2=0, then E=Z1; if P1=1 and P2=0, then E=Z3; if P1=0 and P2=1, then E=Z4; and if P1=1 and P2=1, then E=Z2.

The cylinder indicated in the outcome E is always the particular cylinder that is located in its working phase A. Thus by way of the outcome E, it can be ascertained at any time what phases the individual cylinders of the engine are currently located in.

In operation of the engine, for preparing for a direct start, the engine as it is coming to a stop is purposefully put into an angular position that is advantageous for the direct start. This can be done for instance as in DE 199 60 984 A1.

In an ensuing direct start, with the aid of the two output signals P1 and P2 of FIGS. 2*a* and 2*b*, the particular cylinder of the engine that is currently in its working phase A is determined. This cylinder can be ascertained immediately with the aid of the aforementioned true-power-on sensors.

Fuel is thereupon first injected into that cylinder first and ignited. After that, the fuel is successively injected into the further cylinders and ignited. Overall, a direct start of the engine is thus possible because the engine as it slows to a stop is prepared for an ensuing direct start, and because the cylinder that is in its working phase is ascertained by means of a phase transducer. There is no need for an absolute angle sensor.

In FIGS. 4*a* through 4*d*, output signals P1S1, P1S2, P2S1, P2S2 of a second phase transducer, which is associated with the engine of FIG. 1, are shown. This second phase transducer is largely equivalent to the first phase transducer of FIGS. 2*a* and 2*b*; to this extent, see the description of it made there. The second phase transducer differs from the first phase transducer in that in each of the two transducer wheels, two tracks are provided, and thus each of the two transducer wheels can also be assigned two sensors for the two tracks.

The two transducer wheels and the two tracks associated with each transducer wheel are embodied such that the associated four sensors generate the output signals P1S1, P1S2, P2S1 and P2S2 of FIGS. 4*a* through 4*d*. This can be attained for instance by providing that the transducer wheels, already described, of FIGS. 2*a* and 2*b* of the first phase transducer are used and are additionally each provided with a second track. This second track may be embodied for instance by suitable openings or the like in the respective transducer wheel.

The output signal P1S1 corresponds to the individual phases of the engine of FIG. 1. The output signal P2S1 always changes its value at every other transition between successive phases of FIG. 1. The output signals P1S1 and P2S1 of FIGS. 4*a* and 4*c* correspond to the output signals P1 and P2 of FIGS. 2*a* and 2*b*.

The output signal P1S2 has successive 0 and 1 signals. The duration of the 1 signals corresponds to a predetermined value, and the spacing of successive 1 signals also corresponds to a predetermined value.

The output signal P2S2 is constructed in the same way as the output signal P1S2. However, compared to the signal P1S2, the output signal P2S2 is chronologically shifted by a predetermined value.

Figure 5A:
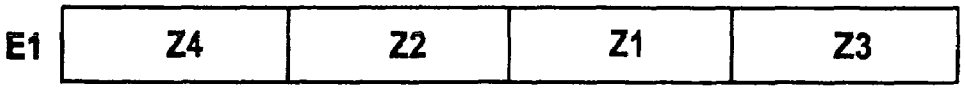
FIGS. 5*a* through 5*c* show schematic timing diagrams of outcomes that characterize the working phases of the individual cylinders of the engine of FIG. 1.
Figure 5B:
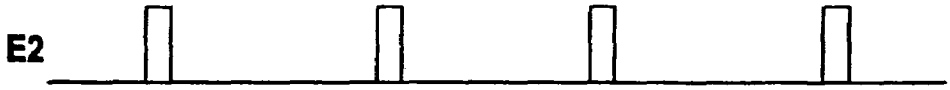
Figure 5C:
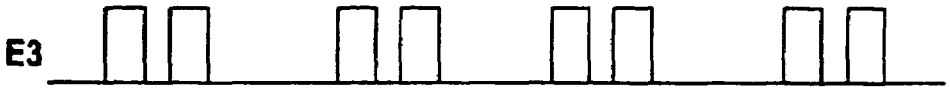

In FIGS. 5*a* through 5*c*, outcomes E1, E2 and E3 are shown, which among other things characterize the working phases of the various cylinders of the engine of FIG. 1.

The outcome E1 of FIG. 5*a* corresponds to the outcome E of FIG. 3. The outcome E1 is the outcome of a combination of the output signals P1S1 and P2S2, as follows: If P1S1=0 and P2S1=0, then E1=Z1; if P1S1=1 and P2S1=0, then E1=Z3; if P1S1=0 and P2S1=1, then E1=Z4; and if P1S1=1 and P2S1=1, then E1=Z2.

The cylinder indicated in the outcome E1 is always the particular cylinder that is located in its working phase A. Thus by way of the outcome E1, it can be ascertained at any time what phases the individual cylinders of the engine are currently located in.

The outcome E2 is the result of an AND operation on the two output signals P1S2 and P2S2. If the outcome E2 is equal to "1", then it characterizes the time or angle range in which a direct start of the engine appears readily possible.

The outcome E3 is the outcome of an EXOR operation on the two output signals P1S2 and P2S2. If the outcome E3 is equal to "1", then it characterizes the time or angle range in which a direct start of the engine is possible only under certain peripheral conditions, for instance only at an engine operating temperature that is within a predetermined temperature range.

If neither the outcome E2 nor the outcome E3 is equal to "1", then a direct start does not appear readily possible, or at least not securely possible.

In engine operation, for preparation for a direct start, the engine as it comes to a stop is purposefully moved into an angular position that is advantageous for the direct start. This can for instance, as already explained, be done as in DE 199 60 984 A1.

Figure 4B:
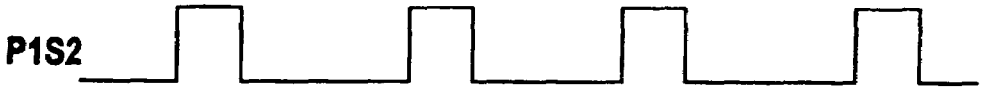
Figure 4C:
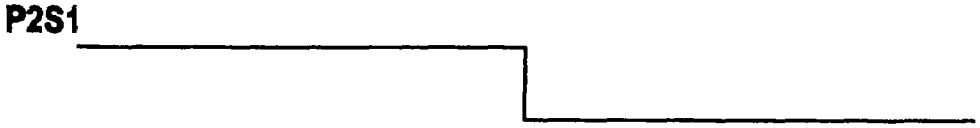

In an ensuing direct start, with the aid of the two output signals P1S1 and P2S1 of FIGS. 4*a* and 4*c*, the particular cylinder of the engine that is currently in its working phase A is determined. This cylinder can be ascertained immediately with the aid of the aforementioned true-power-on sensors.

Figure 4D:
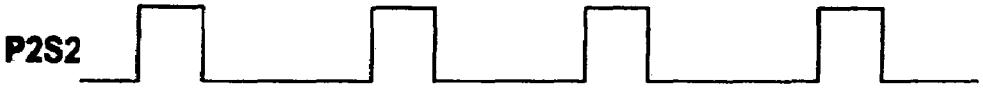

After that, with the aid of the two output signals P1S2 and P2S2 of FIGS. 4*b* and 4*d*, it is ascertained whether a direct start here is readily possible. This is true if the outcome E2 is equal to "1". If so, then fuel is injected first into the cylinder that is in its working phase A, and then ignited. Next, the fuel is injected successively into the further cylinders and ignited. This is done in accordance with the aforementioned known sequence of the cylinders.

If the outcome E2 is not equal to "1", but the outcome E3 is equal to "1", then it is checked whether the required peripheral conditions for a direct start are met, or in other words whether the engine has the required operating temperature, for instance. If so, the direct start is continued by providing that next, fuel is injected first into the cylinder that is in its working phase and the fuel is then ignited, and then the other cylinders are supplied with fuel and ignited in accordance with the known sequence.

However, if it is found that the required peripheral conditions are not met, or if neither the outcome E2 nor the outcome E3 is equal to "1", then a direct start of the engine does not appear readily possible. In that case, other methods for starting the engine are used, which are not the subject of the present patent application.

The above-described methods for starting an internal combustion engine are performed by a control unit, which is quite commonly present for controlling and/or regulating the engine. In particular, the control unit can include a computer program with which the methods described can be performed.

The invention claimed is:

1. A method for operating an internal combustion engine, in particular of a motor vehicle, in which the engine has a number of cylinders (Z1, Z2, Z3, Z4), in which in each of the cylinders (Z1, Z2, Z3, Z4) a movable piston is accommodated which is capable of passing through an intake phase (S), a compression phase (V), a working phase (A), and an expulsion phase (B), and in which the fuel can be injected directly into a combustion chamber defined by the cylinder (Z1, Z2, Z3, Z4) and the piston, wherein a first output signal (P1, P1S1) is generated, which changes its value whenever a transition from one phase to the next phase of the engine is taking place; wherein a second output signal (P2, P2S2) is generated, which always changes its value upon every other transition between two phases of the engine; wherein the two output signals (P1, P1S1; P2, P2S2) are generated independently of each other; wherein from the two output signals, the present phase of at least one of the cylinders (Z1, Z2, Z3, Z4) is ascertained; wherein two further output signals (P1S2, P2S2) are generated, which have successive zero and one signals with predetermined durations, wherein an AND-operator of the two further output signals characterizes a time range or angle range in which a direct start is possible, and wherein an EXOR-operation of the zero and one signals designates a time range or angle range in which a direct start is possible only under certain peripheral conditions.

2. The method as defined by claim 1, wherein the two output signals (P1, P1S1; P2, P2S2) are generated by two sensors in the form of two true-power-on sensors.

3. The method as defined by claim 1, wherein the two sensors are each assigned one transducer wheel that is coupled to the engine.

4. The method as defined by claim 3, wherein the two transducer wheels are assigned to two camshafts of the engine.

5. The method as defined by claim 3, wherein one of the two transducer wheels is assigned to a crankshaft and the other of the two transducer wheels is assigned to a camshaft.

6. A computer program for a control unit of an internal combustion engine, wherein said program is programmed for use in a method for operating an internal combustion engine a motor vehicle, in which the engine has a number of cylinders (Z1, Z2, Z3, Z4), in which in each of the cylinders (Z1, Z2, Z3, Z4) a movable piston is accommodated which is capable of passing through an intake phase (S), a compression phase (V), a working phase (A), and an expulsion phase (B), and in which the fuel can be injected directly into a combustion chamber defined by the cylinder (Z1, Z2, Z3, Z4) and the piston, that wherein a first output signal (P1, P1S1) is generated, which changes its value whenever a transition from one phase to the next phase of the engine is taking place; wherein a second output signal (P2, P2S2) is generated, which always changes its value upon every other transition between two phases of the engine; wherein the two output signals (P1, P1S1; P2, P2S2) are generated independently of each other; wherein from the two output signals, the present phase of at least one of the cylinders (Z1, Z2, Z3, Z4) is ascertained; wherein two further output signals (P1S2, P2S2) are generated, which have successive zero and one signals with predetermined durations, wherein an AND-operator of the two further output signals characterizes a time range or angle range in which a direct start is possible, and wherein an EXOR-operation of the zero and one signals designates a time range or angle range in which a direct start is possible only under certain peripheral conditions.

7. A control unit for an internal combustion engine of a motor vehicle, in which the engine has a number of cylinders (Z1, Z2, Z3, Z4), in which in each of the cylinders (Z1, Z2, Z3, Z4) a movable piston is accommodated which is capable of passing through an intake phase (S), a compression phase (V), a working phase (A), and an expulsion phase (B), and in which the fuel can be injected directly into a combustion chamber defined by the cylinder (Z1, Z2, Z3, Z4) and the piston, wherein by means of the control unit, a first output signal (P1, P1S1) can be generated, which changes its value whenever a transition from one phase to the next phase of the engine is taking place; that by means of the control unit, a second output signal (P2, P2S2) can be generated, which always changes its value upon every other transition between two phases of the engine; that the two output signals (P1, P1S1; P2, P2S2) can be generated independently of each other; and that by means of the control unit from the two output signals, the present phase of at least one of the cylinders (Z1, Z2, Z3, Z4) can be ascertained.

8. An internal combustion engine for a motor vehicle, comprising a control unit, in which the engine has a number of cylinders (Z1, Z2, Z3, Z4), in which in each of the cylinders (Z1, Z2, Z3, Z4) a movable piston is accommodated which is capable of passing through an intake phase (S), a compression phase (V), a working phase (A), and an expulsion phase (B), and in which the fuel can be injected directly into a combustion chamber defined by the cylinder (Z1, Z2, Z3, Z4) and the piston, wherein by means of the control unit, a first output signal (P1, P1S1) can be generated, which changes its value whenever a transition from one phase to the next phase of the engine is taking place; that by means of the control unit, a second output signal (P2, P2S2) can be generated, which always changes its value upon every other transition between two phases of the engine; that the two output signals (P1, P1S1; P2, P2S2) can be generated independently of each other; and that by means of the control unit from the two output signals, the present phase of at least one of the cylinders (Z1, Z2, Z3, Z4) can be ascertained.

* * * * *